US006437261B1

(12) United States Patent
Bryant et al.

(10) Patent No.: US 6,437,261 B1
(45) Date of Patent: Aug. 20, 2002

(54) INTERLOCK FOR USE IN AN ELECTRIC MOTOR HANDLE AND CONTACTOR COMBINATION

(75) Inventors: Michael Ray Bryant, Gibsonville; Robert Dale Joyner, Haw River; William Glenn Sims, Burlington, all of NC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/206,489

(22) Filed: Dec. 7, 1998

(51) Int. Cl.[7] ..... H01H 9/28

(52) U.S. Cl. ..... 200/43.16; 200/50.01; 200/318

(58) Field of Search ..... 200/43.11, 43.14, 200/43.15–43.16, 50.01, 50.02, 50.19, 50.11, 318, 321

(56) References Cited

U.S. PATENT DOCUMENTS

| | | | | | |
|---|---|---|---|---|---|
| 2,882,359 | A | * | 4/1959 | Edmunds et al. | 200/50 |
| 3,198,910 | A | | 8/1965 | Burch et al. | 200/104 |
| 3,621,339 | A | | 11/1971 | Hodgson | 317/103 |
| 4,202,027 | A | * | 5/1980 | Ericson | 361/338 |
| 4,485,366 | A | * | 11/1984 | Basnett | 335/160 |
| 4,760,220 | A | | 7/1988 | Fritsch et al. | 200/50 |
| 5,057,962 | A | | 10/1991 | Alley et al. | 361/24 |
| 5,164,695 | A | * | 11/1992 | Monson et al. | 335/202 |
| 5,424,911 | A | | 6/1995 | Joyner et al. | 361/616 |
| 5,493,084 | A | * | 2/1996 | Whitaker et al. | 200/50 |
| 5,821,487 | A | * | 10/1998 | Groves et al. | 200/50 |
| 5,945,648 | A | * | 8/1999 | M'Sadoques | 200/43.14 |

* cited by examiner

*Primary Examiner*—Elvin Enad
*Assistant Examiner*—Kyung S. Lee
(74) *Attorney, Agent, or Firm*—Cantor Colburn LLP

(57) ABSTRACT

An interlock mechanism for preventing or enabling the operation of a handle operator or a contactor in certain circumstances comprises a system of mechanical linkages which interact to determine whether a lock-out mode or an enabling mode exists with respect to the electric motor being controlled. In the handle assembly, the lock-out bar has a circular aperture that receives a push rod in the enable mode and blocks the push rod in the lock-out mode. The push rod is connected to a blocking bracket which must be depressed by a human operator prior to cycling the handle operator. If the blocking bracket cannot be fully depressed by the human operator because the push rod is blocked by the lock-out bar, then the human operator can not cycle the handle operator between its OFF and ON positions, thus a first half of the interlock is achieved. Conversely, the interlock is also designed to prevent the contactor from supplying power to the electric motor if the handle operator is being cycled. If the switch has been closed (handle operator is in the ON position) and power has been supplied to the contactor but not yet to the electric motor, and the blocking bracket has been activated successfully such that the push rod has engaged the lock-out bar, then the contactor pawl assembly is unable to move and thus the contactor cannot be command to supply power to the electric motor. Thus a two way mechanical interlock is achieved.

7 Claims, 12 Drawing Sheets

INTERLOCK FOR USE IN AN ELECTRIC MOTOR HANDLE AND CONTACTOR COMBINATION

BACKGROUND OF THE INVENTION

1. Field of the Invention

The present invention is generally directed to the method and design of mechanical interlock linkages for electrical equipment. More particularly, the present invention is directed to an improved interlock linkage for use in a handle/switch/contactor combination as applied to high powered electric motors. The improved interlock design and method greatly improves reliability, defects per million opportunities, part count, and manufacturing costs.

2. Prior Art

The present invention is an improvement over the prior art. Specifically U.S. Pat. No. 5,424,911 to Joyner et al. disclosed a compact motor controller assembly. Motor controller equipment generally includes so-called "high voltage" motor contactors such as described within U.S. Pat. No. 3,198,910 entitled "Electromagnetic Relay Having Removable Contact and Coil Assemblies" as well as "low voltage" equipment in the form of relays and the like. One such relay being that described within U.S. Pat. No. 5,057,962 entitled "Microprocessor Based Protective Relay System."

The motor controller equipment is interlocked with the externally accessible handle operator to prevent access to the high voltage equipment when the operating handle is in the ON position. U.S. Pat. No. 4,760,220 entitled "operator Mechanism Having reduced Handle Throw and Improved Handle Lock" is one example of such an interlock.

The state of the art of such motor controller equipment is to mount the low voltage equipment in cabinets having a separate access door from that of the high voltage contactor within a separate compartment to allow ready access to the low voltage equipment without having to turn off the contactor. U.S. Pat. No. 3,621,339 entitled "Modular High Voltage Electrical Components Cooperating Within Cabinet Housing to Provide Electrical Insulation and Cooling Air Passage" describes the separate arrangement of the high voltage contactors and low voltage equipment.

Therefore it has been determined that a need exists for an improved design of the interlock which increases reliability, lowers part count and manufacturing costs, all while improving operability.

SUMMARY OF THE INVENTION

In accordance with a preferred embodiment of the present invention, an interlock mechanism for preventing or enabling the operation of a handle operator or a contactor in certain circumstances comprises a system of mechanical linkages which interact to determine whether a lock-out mode or an enabling mode exists with respect to the electric motor being controlled. A handle operator controls a switch which makes or breaks power to the contactor. Once the contactor has been supplied power by the switch, the contactor may then be commanded to supply and remove electric power to and from the electric motor. If the contactor is supplying power to the electric motor, the contactor activates a contactor pawl assembly to initiate a handle lock-out mode. The contactor pawl assembly displaces a lock-out bar in a linear manner which causes the handle operator to be locked-out. In the handle assembly, the lock-out bar has a circular aperture that receives a push rod in the enable mode and blocks the push rod in the lock-out mode. The push rod is connected to a blocking bracket which must be depressed by a human operator prior to cycling the handle operator. If the blocking bracket cannot be fully depressed by the human operator because the push rod is blocked by the lock-out bar, then the human operator can not cycle the handle operator between its OFF and ON positions, thus a first half of the interlock is achieved. Conversely, the interlock is also designed to prevent the contactor from supplying power to the electric motor if the handle operator is being cycled. If the switch has been closed (handle operator is in the ON position) and power has been supplied to the contactor but not yet to the electric motor, and the blocking bracket has been activated successfully such that the push rod has engaged the lock-out bar, then the contactor pawl assembly is unable to move and thus the contactor cannot be command to supply power to the electric motor. Thus a two way mechanical interlock is achieved.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE INVENTION

Figure 1:
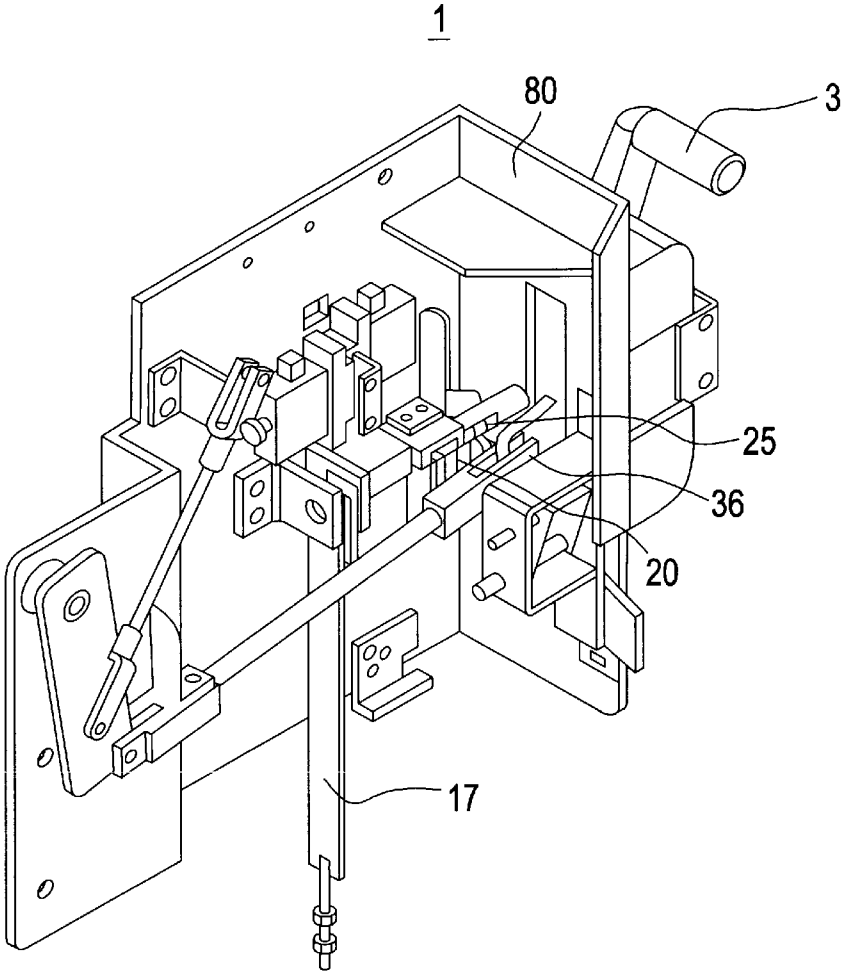
FIG. 1 is a perspective view of a handle assembly illustrating the internal structure including several mechanical linkages.

Referring now to FIG. 1, a perspective view of a handle assembly illustrating the internal structure including several mechanical linkages is shown. The handle operator 3 is currently shown in an ON position. When the handle operator 3 is moved downward to its lowest allowed position, it is in the OFF position 3A (dashed handle). When the handle operator 3 is moved from one position to the other, it is said to have 'cycled.' A mechanical interlock circuit (described below) either allows or prevents, depending certain conditions, the handle operator 3 to be cycled, or (as later described) the contactor to supply power to the electric motor. The lock-out bar 17 should be noted as it extends in a downward fashion from the handle assembly 1. The adjustment pin 105 of the lock-out bar 17 is mechanically connected to and operated by a contactor pawl assembly 150 (not shown) as described in detail below.

Figure 2:
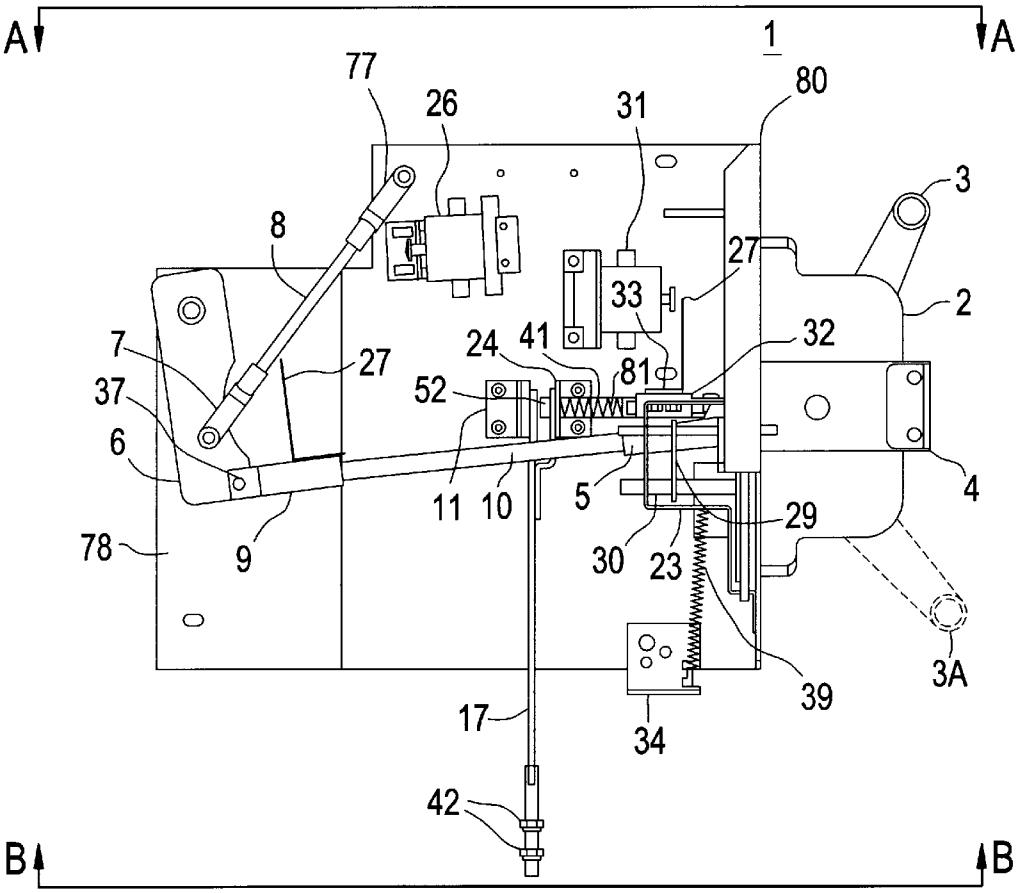
FIG. 2 is a side elevation view of a handle assembly illustrating the internal structure including several mechanical linkages and position switches.

Referring to FIG. 2, a side elevation view of the handle assembly 1 is shown. The handle assembly 1 is used to open and close a switch (separate assembly, not shown) which supplies electrical power to the contactor (not shown). The handle 3 (shown in the ON position) is coupled to a first fork 5 (see FIG. 4) of horizontal rod 10 and a second fork 9 of the rod 10 is pivotally connected to a bell crank lever 6. An inclined rod 8 has a first fork 7 pivotally mounted to the bell crank 6 and a second fork 77 which is connected to a switch assembly (not shown). The bell crank 6 is rotatably mounted to the handle assembly support frame 78 at pivot point $P_1$.

Disregarding the interlock mechanism for the moment, and considering only the operation of the handle 3 with respect to the switch, the handle is shown in the ON position. When the handle 3 is cycled to the OFF position 3A, the horizontal rod 10 is retracted towards the handle housing 2 causing the bell crank 6 to rotate in a counter-clockwise manner, further causing inclined rod 8 to move in an upward manner and imparting such motion to the switch assembly (not shown). When the handle 3 is cycled from the OFF position 3A back to the ON position 3, just the opposite occurs with respect to the mechanical linkage. As the handle 3 cycles from OFF to ON, the horizontal rod 10 is forced to extend away from the handle housing 2 causing bell crank 6 to rotate in a clockwise manner, and further causing inclined rod 8 to move in a downward manner and imparting such motion to the switch assembly. This is the manner in which the handle 3 cycles power to and from the contactor.

Referring to FIG. 2, further, an interlock feature is described. Blocking bracket 4 is slidably mounted on the handle housing 2 and springedly predisposed to rest away from the handle housing 2 in its normal handle lockout position. In the normal handle lockout position, the blocking bracket provides a mechanical interference so that the handle operator 3 cannot cycle. The blocking bracket 4 is connected to a first end 51 of push rod 41 (see FIG. 4) while the opposing or second end 52 of the push rod 41 is laterally restrained by a circular aperture 25 in support bracket 24 which is mounted on the support frame 78 of the handle assembly 1. The push rod 41 passes through and supports a helical spring 81 which is longitudinally restrained at one end by the support bracket 24 and exerts a repositioning force on the blocking bracket 4. A companion support bracket 11 is mounted further aft of support bracket 24 and aligned to receive the opposing or second end 52 of the push rod 41. Between the support brackets 11 & 24, the lock-out bar 17 is suspended from the push rod 41 as described below. The preferred diameter of the push rod 41 including its second end 52 is 0.500 in. and the preferred diameter of the circular aperture 25 in the right support bracket 24 is 0.560 in.

Figure 3:
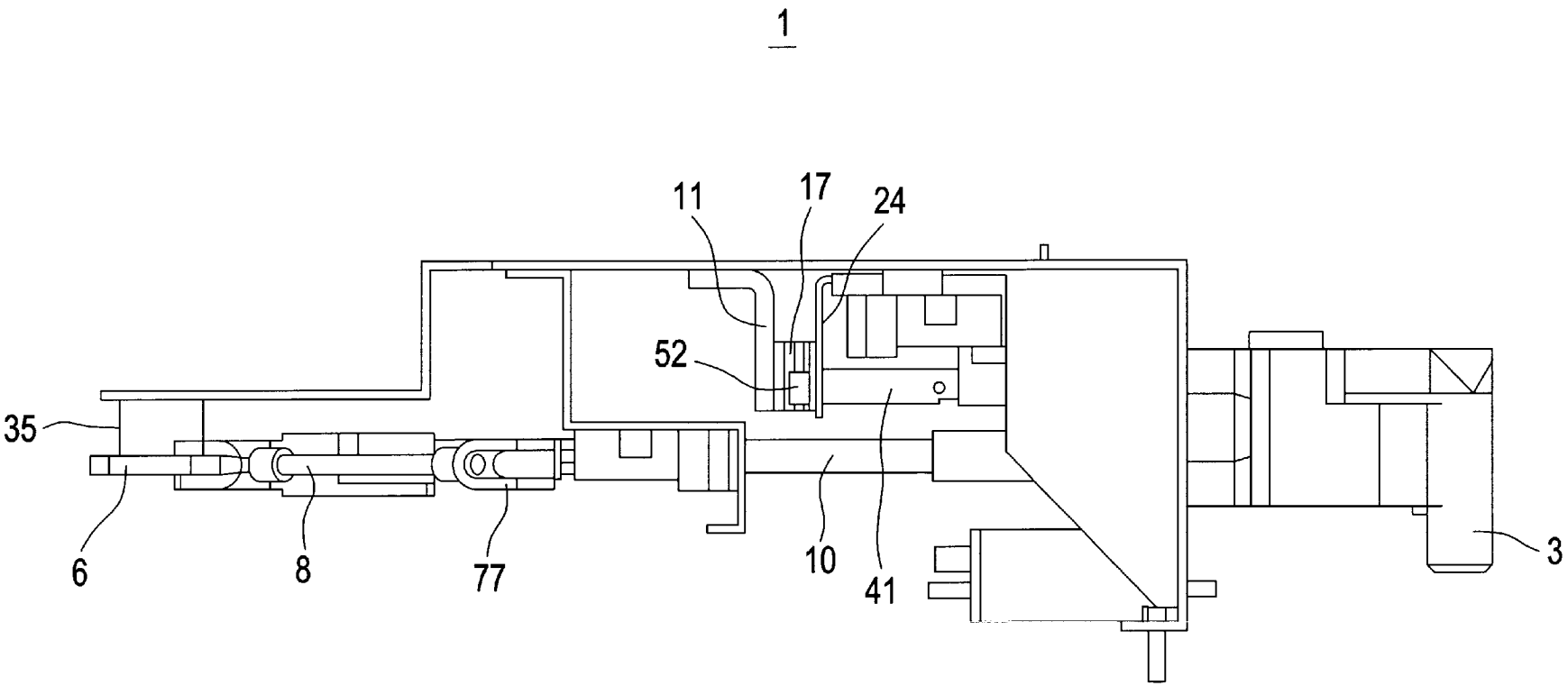
FIG. 3 is a top plan view of the handle assembly of FIG. 2 taken along line AA.

Referring to FIG. 3, a top plan view of the handle assembly 1 taken along line AA of FIG. 2 is shown. It can be seen that the handle 3, horizontal rod 10, bell crank 6, and inclined rod 8 all lie in the same vertical plane. It is also shown that the spring loaded push rod 41 operates on a parallel axis to the horizontal rod 10 but in a separate vertical plane. In this drawing the blocking bracket 4 and spring loaded push rod 41 (spring not shown) are at rest with the second end 52 of push rod 41 located between the left support bracket 11 and the right support bracket 24. In this position, as will be further described below, the lock-out bar 17 may be activated by the contactor pawl assembly 150 (not shown) to either an up or down position.

Figure 4:
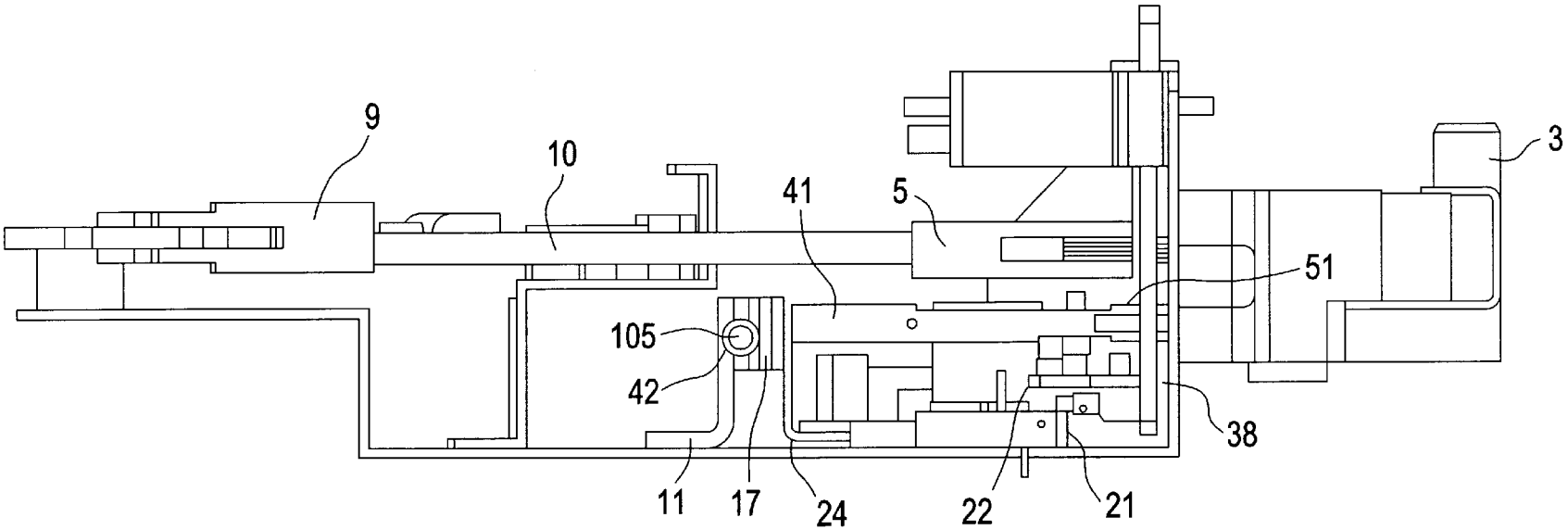
FIG. 4 is a bottom plan view of the handle assembly of FIG. 2 taken along line BB.

Referring to FIG. 4, a bottom plan view of the handle assembly 1 taken along line BB of FIG. 2 is shown. The adjustment pin 105 is shown with an adjusting nut 42 mounted about the pin 105. The adjustment pin 105 and several adjusting nuts 42 are used to connect the lock-out bar 17 to the contactor pawl assembly 150 as described in detail below.

Figure 5C:
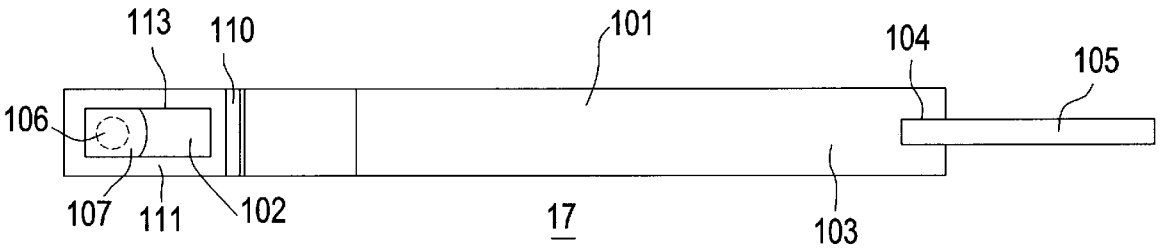
FIG. 5C is a top plan view of a lock-out bar showing the rectangular aperture in the z-bracket and the circular aperture in the lock-out bar head section.
Figure 5B:
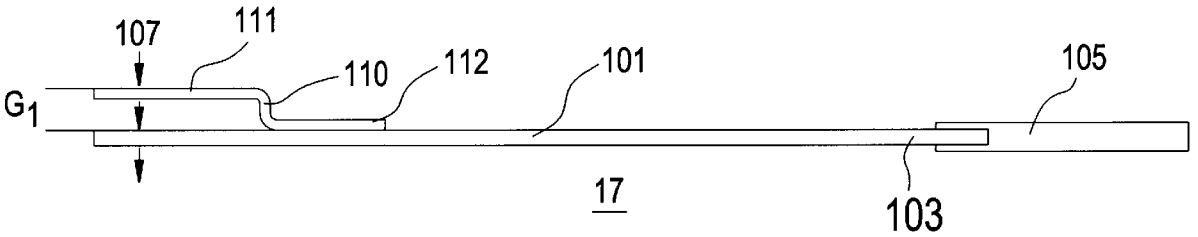
FIG. 5B is a side elevation view of a lock-out bar showing the z-bracket and the adjustment pin.
Figure 5A:
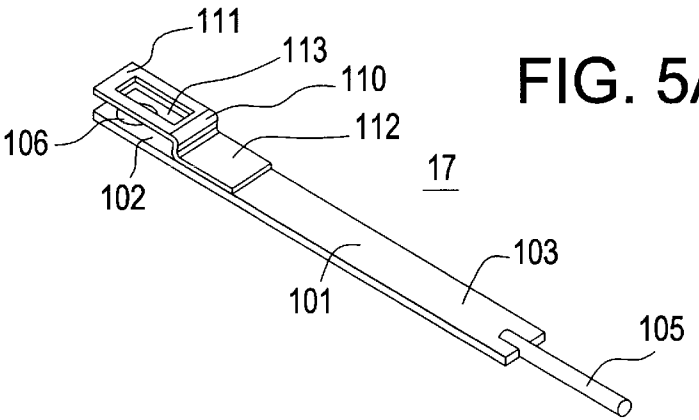
FIG. 5A is a perspective view of a lock-out bar which is the mechanical link between the handle assembly and the contactor assembly.

Referring to FIG. 5A, a perspective view of a lock-out bar 17 which is the mechanical and operational link between the handle assembly 1 and the contactor assembly 150 is shown. The bar 17 is formed from an elongated plate having a head 102, a body 101, and a base 103. A slot 104 is formed in the base 103 so as to receive an adjustment pin 105. The pin 105 is rigidly held in the slot 104 using the preferred method of a mig-weld. A circular aperture 106 is formed in the head 102 of sufficient diameter to receive and allow a second end 52 of push rod 41 to pass through the head 102 of the lock-out bar 17 as further described below.

A z-bracket 110 having a top leg 111 and a bottom leg 112 is secured to the head 102 of the bar 17 by using well know mechanical means such as spot welding. The z-bracket 110 is dimensioned and positioned such that the perimeter surfaces of the top leg 111 are flush with the perimeter of the head 102 of the bar 17. A rectangular aperture 113 is formed in the top leg 111 of the z-bracket 110 and through which the push rod 41 will pass and slide in a horizontal manner. Further the rectangular aperture 113 will allow for the bar 17 to move in a vertical manner, up and down, relative to the push rod 41. The preferred dimensions of the rectangular aperture 113 are 0.560 in. wide and 1.50 in. long. The width of the rectangular aperture is in close tolerance to the diameter of the push rod 41 (0.500 in.) so as to keep the lock-out bar 17 fairly restrained in lateral movement.

Referring to FIG. 5B, a side elevation view of a lock-out bar 17 illustrating a z-bracket 110 and an adjustment pin 105 is shown. The top leg 111 of the z-bracket 110 is substantially parallel to the head 102 of the bar 17 and the two surfaces are separated by a predetermined gap $G_1$. The preferred dimension of the gap $G_1$ is 0.50 in. and is designed into the bar 17 to allow the push rod 41 and bar 17 to interact in a novel manner more particularly described below.

Referring to FIG. 5C, a top plan view of a lock-out bar 17 illustrating the alignment of the rectangular aperture 113 in the top leg 111 of the z-bracket 110 with the circular aperture 106 in the head 102 of the bar 17 is shown. As can be seen in this view, a portion of the rectangular aperture 113 and a portion of the circular aperture 106 over lap each other providing a continuous through-hole path 107 in the bar 17. This dimensions of the continuous through-hole path 107 are predetermined to allow the push rod 41 to slide unimpeded through both the rectangular aperture 113 and the circular aperture 106 during certain configurations of the bar 17 and the push rod 41 as more particularly described below.

The preferred diameter of circular aperture 106 is 0.750 in. and the center of the aperture 106 is located on the head 102 of the bar 17 such that when the lock-out bar 17 is being supported by the push rod 41, i.e., when the push rod 41 is in contact with the upper edge of the rectangular aperture 113, then the center of push rod 41 is axially aligned with the center of circular aperture 106. This provides a clearance about the push rod 41 with respect to circular aperture 106 when the push rod 41 is activated. When a human operator pushes on the blocking bracket 4, the push rod (O.D. 0.500 in.) will smoothly pass through circular aperture 106 (I.D. 0.750 in.) as long as the lock-out bar 17 is in the enable position.

Figure 5D:
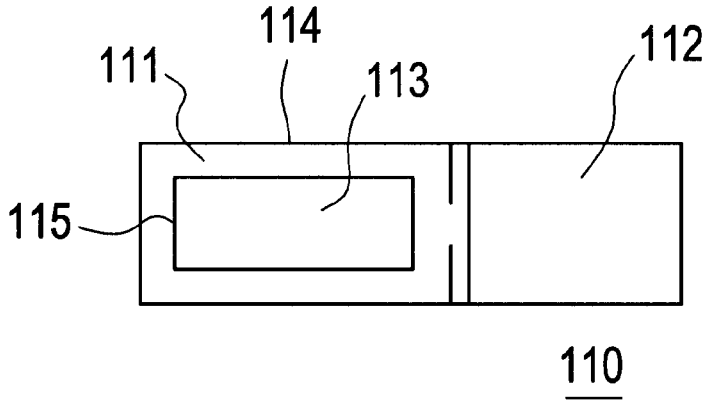
FIG. 5D is a top plan view of a z-bracket showing the rectangular aperture in the z-bracket and other preferred dimensions.

Referring to FIG. 5D, a top plan view of a z-bracket 110 showing the rectangular aperture 113 in the z-bracket 110 and other preferred dimensions is shown. The width of the rectangular aperture 113 is 0.560 in and the length is 1.50 in. The overall width of the z-bracket is 1.0 in. The rectangular aperture 113 is offset from the side edge 114 by 0.220 in. and offset from the top edge 115 by 0.250 in.

Figure 5E:
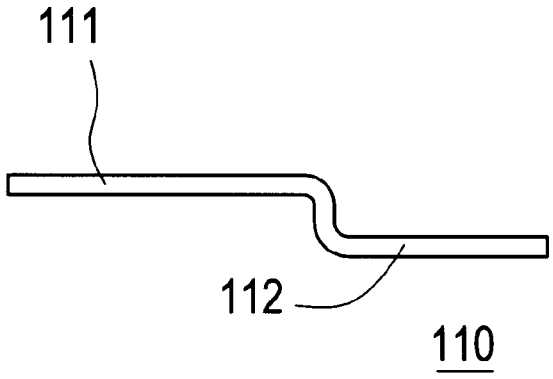
FIG. 5E is a side elevation view of a z-bracket showing the z-shape and other preferred dimensions.

Referring to FIG. 5E, a side elevation view of a z-bracket 110 showing the z-shape and other preferred dimensions is shown. The overall length of the z-bracket 110 is 3.50 in. with a height of 0.50 in. from outside bottom leg 112 to outside top leg 111. The overall length of the top leg 111 is 2.0 in. The overall length of the bottom leg 112 is 1.50 in.

Figure 6A:
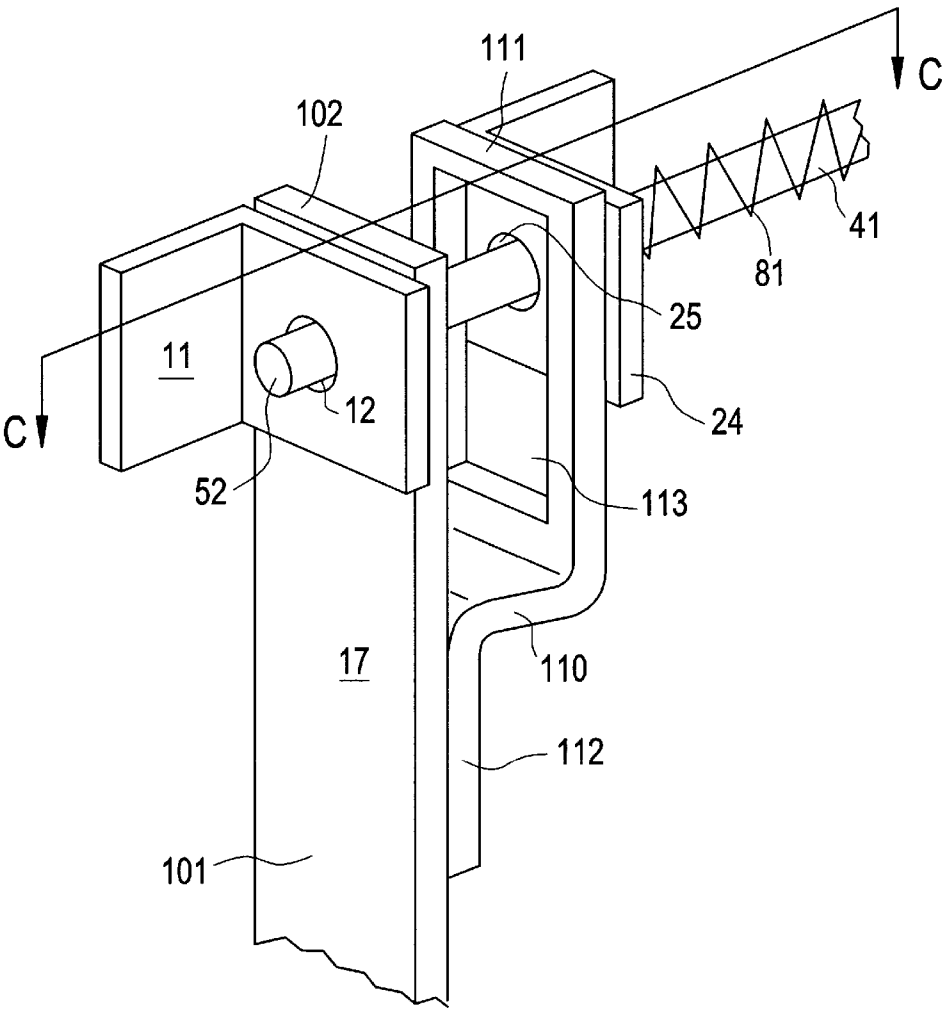
FIG. 6A is a perspective view of a the top section of the lock-out bar in the enable position allowing the push rod end to travel laterally through the left support bracket.
Figure 6B:
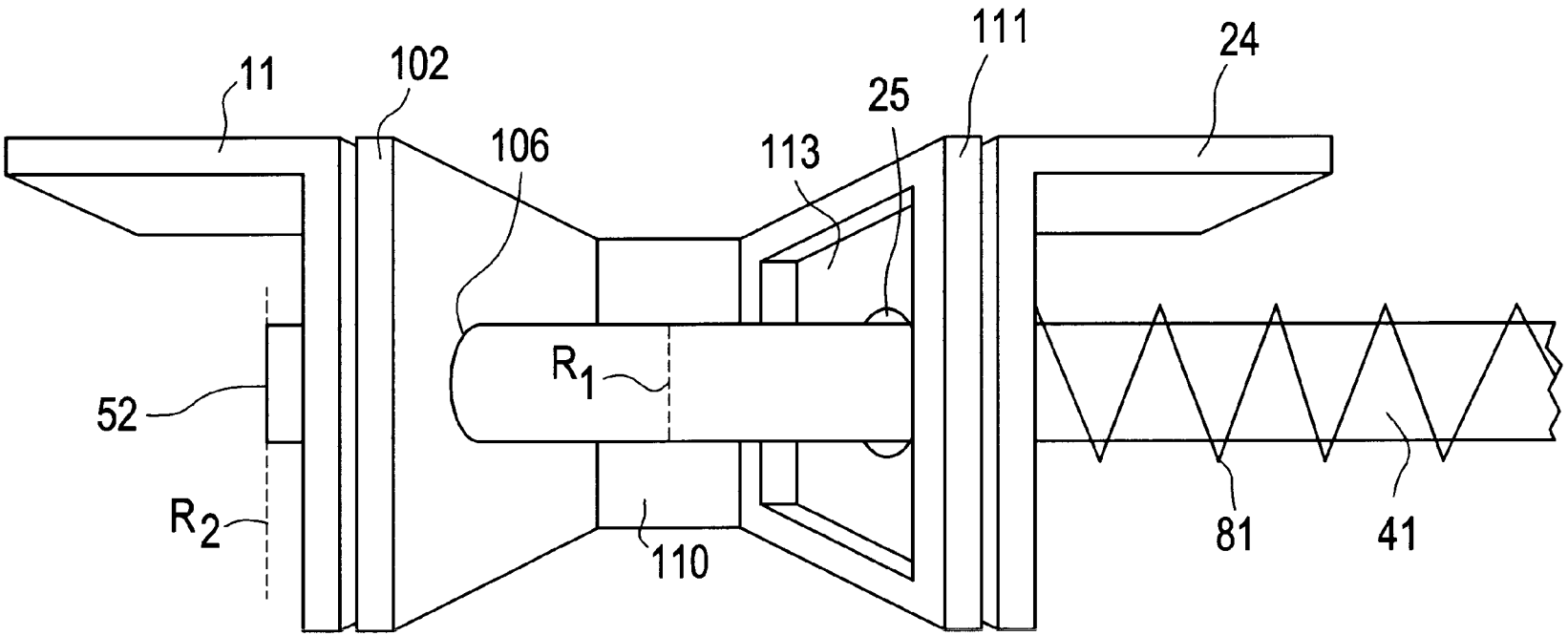
FIG. 6B is a perspective view of FIG. 6A along line CC illustrating how the push rod end has traveled through the left support bracket.

Referring now to FIGS. 6A & 6B, the enabling mode of the lock-out bar 17 is shown. In FIG. 6A, a perspective view illustrating the top section of the lock-out bar 17, respective left and right support brackets 11 & 24, helical spring 81 and a push rod 41 is shown. In FIG. 6B a perspective view of FIG. 6A along line CC is shown.

In the enabling mode as shown in FIGS. 6A & 6B, the push rod 41 has been displaced successfully towards and through the left support bracket 11 by the blocking bracket 4 (not shown) to a handle operational position $R_2$. In these figures, the lock-out bar 17 is in the enable position (down) allowing the push rod end 52 to travel laterally through, first, the circular aperture 106 in the head 102 of the bar 17, and second, through the circular aperture 12 in the left bracket 11. The preferred diameter of circular aperture 12 is 0.600 in. Once the push rod 41 has traveled through the aperture 12 of the left support bracket 11 so that the second end 52 of the push rod 41 passes through the plane $R_2$, the blocking bracket 4 has been displaced a sufficient lateral distance to allow the handle operator 3 to be cycled. When the blocking bracket 4 is not being displaced by human force, it is driven away from the handle housing 2 by the helical spring 81 to a rest position. The push rod 41 and its second end 52 comes to rest inside the gap $G_1$ at a location shown by doffed line $R_1$ in FIG. 6B. When the push rod 41 is in this rest position $R_1$, it can be seen that the lock-out bar 17 may be displaced up and down in a vertical manner by the contactor pawl assembly 150 because the bar 17 has a rectangular aperture 113 which allows for this movement about the then stationary push rod 41.

Figure 6C:
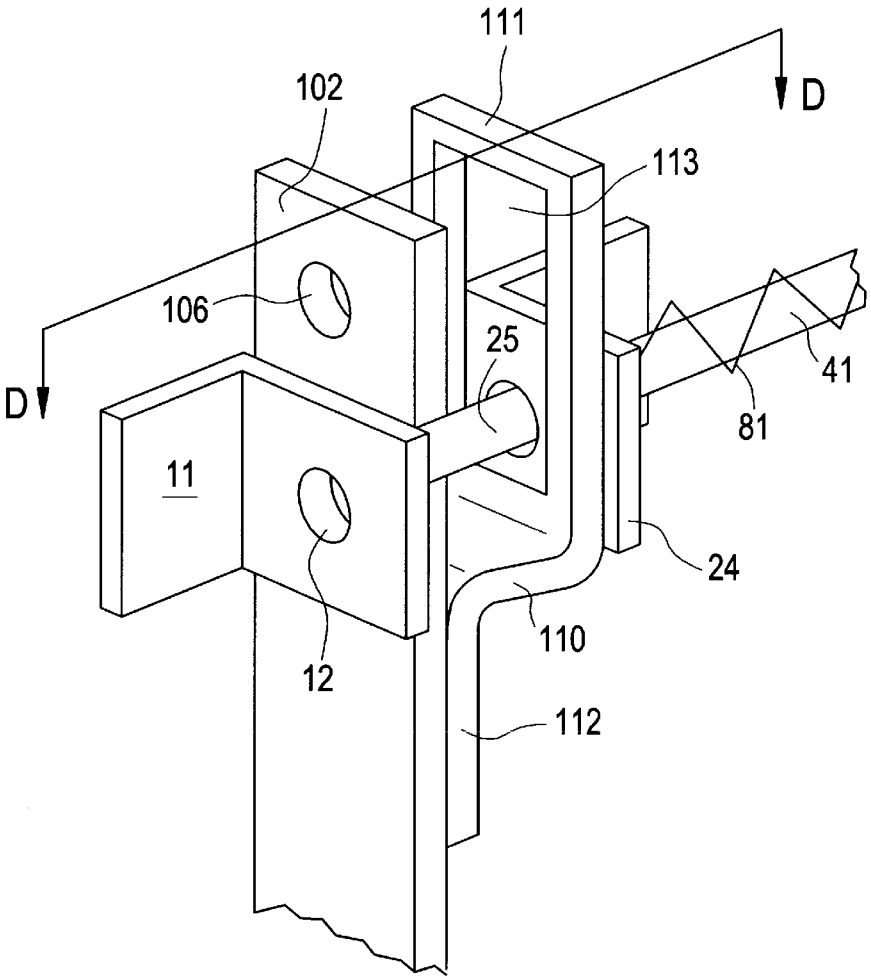
FIG. 6C is a perspective view of a the top section of the lock-out bar in the lock-out position blocking the push rod end from traveling laterally through the left support bracket.
Figure 6D:
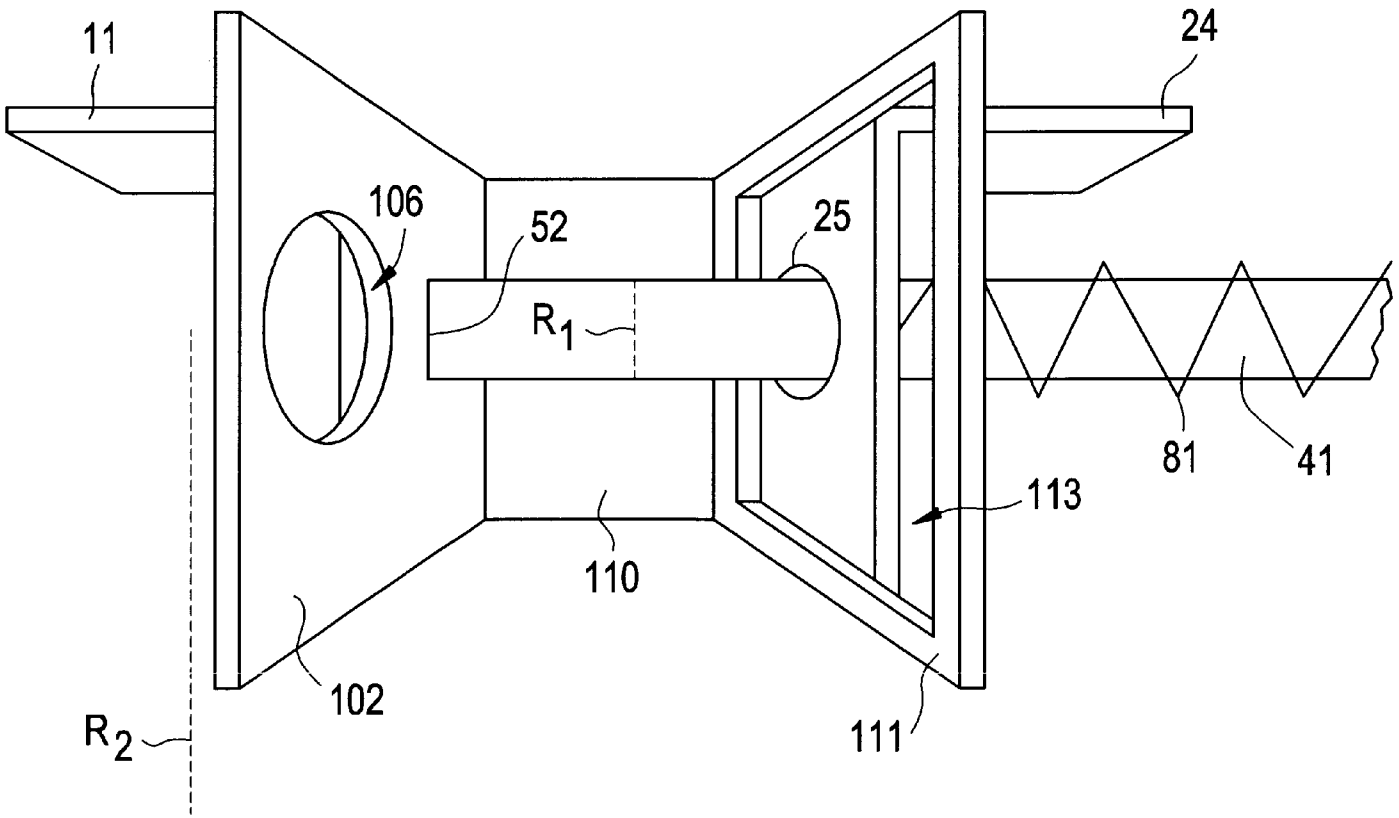
FIG. 6D is a perspective view of FIG. 6C along line DD illustrating how the push rod is blocked from travelling laterally by the vertically raised lock-out bar.

Referring now to FIGS. 6C & 6D, the lock-out mode of the lock-out bar 17 is shown. In FIG. 6C, a perspective view illustrating the top section of the lock-out bar 17, respective left and right support brackets 11 & 24, helical spring 81 and a push rod 41 is shown. In FIG. 6D, a perspective view of FIG. 6C along line DD is shown.

In the lock-out mode as shown in FIGS. 6C & 6D, the lock-out bar 17 has been vertically raised by the contactor pawl assembly 150 (not shown) so that circular aperture 106 in the head 102 is no longer axially aligned with push rod 41. The rectangular opening 113 in the top leg 111 of the z-bracket 110 is dimensioned longitudinally so that the bar 17 can move a sufficient vertical distance to misalign circular aperture 106 and the push rod 41. Thus when the push rod 41 is displaced laterally by the blocking bracket 4 from rest position $R_1$ towards handle operational position $R_2$, the path and movement of push rod 41 are blocked by the head 102 of the bar 17. Therefore the blocking bracket 4, which can not now be sufficiently depressed by the human operator, is still blocking the path of the handle operator 3 and the handle operator 3 can not be cycled between ON and OFF positions.

It will be understood by those skilled in the art that the push rod second end 52 forms a 'key' and that circular aperture 106 forms a 'keyway' to receive the 'key'. It is noted that a key/keyway could be constructed from other matching shapes besides a rod/hole pair and that such shapes would perform the same enabling or blocking functions.

Figure 7A:
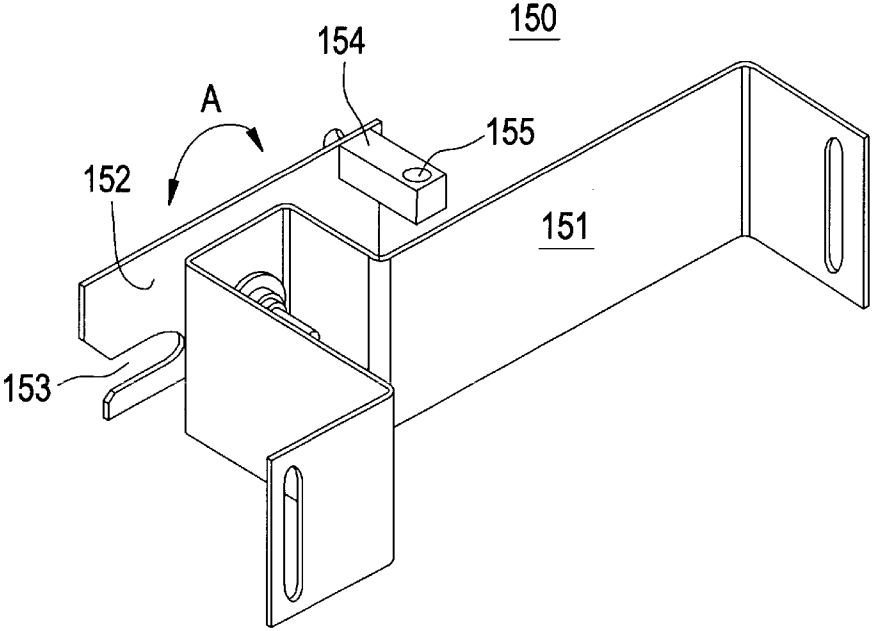
FIG. 7A is a perspective view of a contactor pawl assembly illustrating a mounting bracket and the rotating plate.

Referring to FIG. 7A, a perspective view of a contactor pawl assembly 150 illustrating a mounting bracket 151 and a rotating plate 152 is shown. The contactor pawl assembly 150 is mechanically linked to a contactor (not shown) by a linkage member (not shown) having one end confined to a mouth 153. Thus when the contactor applies power to the electric motor, the linkage member deflects the mouth 153 in a downward manner causing the plate 152 to rotate about arc A,. This rotation raises up rod attachment block 154. Rod attachment block 154 has a through-hole 155 which receives the adjustment pin 105 of lock-out bar 17. Adjusting nuts 42 are located on the adjustment pin 105 above and below rod attachment block 154 securing the pin 105 to the block 154. The adjustment nuts 42 are used to bring the linkages into proper alignment.

As the rod attachment block 154 is raised, the adjustment pin 105 is also raised forcing the lock-out bar 17 to also be raised, thus misaligning the push rod 41 and the circular aperture 106 putting the lock-out bar 17 in the lock-out mode as described above.

After the contactor has removed electric power from the electric motor, the linkage from the contactor to the mouth 153 rotates the mouth 153 in an upward direction, with the rod attachment block 154 and adjustment pin 105 being moved downward to the enable position. Thus the lock-out bar 17 is lowered and the push rod 41 is axially aligned with the circular aperture 106 which allows for the push rod 41 to be displaced horizontally to the handle operational position $R_2$. Now the handle operator 3 can be safely cycled as power has been removed from the electric motor.

Figure 7B:
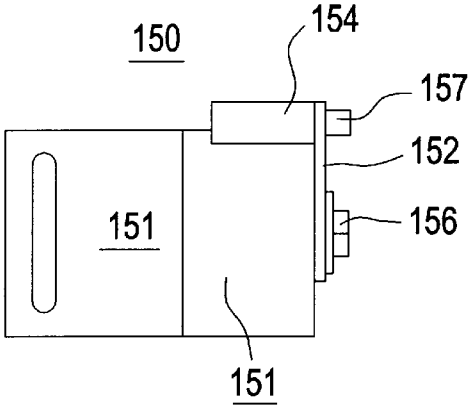
FIG. 7B is a rear elevation view of a contactor pawl assembly illustrating a mounting bracket and a rod attachment block.

Referring now to FIG. 7B, a rear elevation view of a contactor pawl assembly 150 illustrating a mounting bracket 151, rotating plate 152, bolt assembly 156, rod attachment block 154, and cylindrical shoulder 157 are shown. It should be noted that the rod attachment block 154 may rotate relative to the plate 152 due to its cylindrical shoulder 157. This eliminates any rotational motion to be imparted from the plate 152 to the lock-out bar 17 through the adjustment pin 105.

Figure 7C:
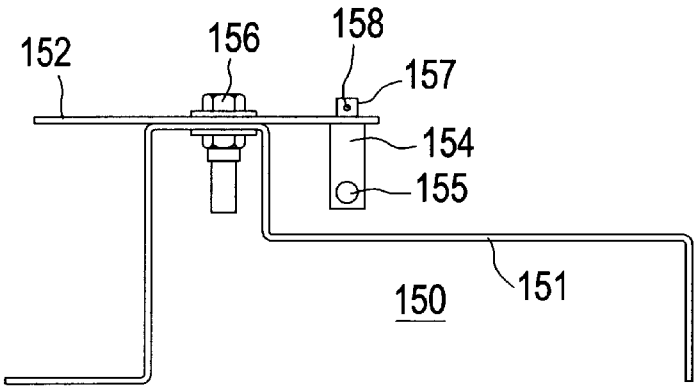
FIG. 7C is a top plan view of a contactor pawl assembly illustrating a mounting bracket, rod attachment block, pin hole, rotating plate and bolt assembly.

Referring to FIG. 7C, a top plan view of a contactor pawl assembly 150 illustrating a mounting bracket 151, a rod attachment block 154, a through-hole 155, a cylindrical shoulder 157, a cotter pin hole 158, a rotating plate 152, and bolt assembly 156 is shown. The rod attachment block 154 is rotatably mounted to the plate 152 by passing its cylindrical shoulder 157 through a hole in the plate 152, sliding a washer over the shoulder 157 and capturing the shoulder 157 with a cotter pin assembled in cotter pin hole 158 in a manner well know in the art.

Figure 7D:
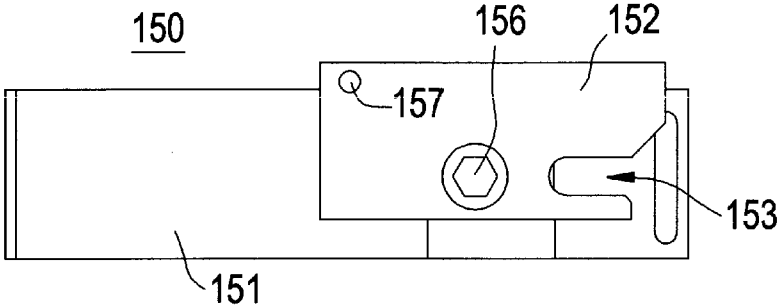
FIG. 7D is a side elevation view of a contactor pawl assembly illustrating a mounting bracket, rotating plate, mouth and bolt assembly.

Referring now to FIG. 7D, a side elevation view of a contactor pawl assembly 150 illustrating a mounting bracket 151, a rotating plate 152, a cylindrical shoulder 157, and bolt assembly 156 is shown. It can be seen that when the linkage from the contactor (not shown) drives the mouth 153 of the rotating plate 152, such motion is inverted with respect to the motion imparted to the adjustment pin 105 captured in the rod attachment block 154. That is, when the contactor (not shown) drives the mouth 153 upward to the enable mode position, the rotating plate 152 causes the rod attachment block 154 to descend pulling down the lock-out bar 17 and allowing axial alignment of the circular aperture 106 with the push rod 41 so that the push rod 41 may be successfully received by the circular aperture 106 if the blocking bracket 4 is depressed. Finally when the contactor drives the mouth 153 downward to the lock-out position, the rotating plate 152 causes the rod attachment block 154 to rise pushing up the lock-out bar 17, and causing misalignment of the circular aperture 106 with the push rod 41 so that when the blocking bracket 4 is depressed, it can not be fully depressed as the push rod 41 is blocked by the head 102 of the lock-out bar 17, thus preventing the handle operator 3 from being cycled between ON and OFF positions.

It will also be appreciated by those skilled in the art that when the push rod 41 has been activated and passed through aperture 106, the contactor pawl assembly cannot pull the bar 17 down in response to a demand from the contactor (not shown) to close. Thus, the interlock also prevents the closing of the contactor when the handle operator 3 is about to be cycled. This would occur in a situation where a hot contactor (switch is closed supplying power to the contactor) was being commanded to turn on the motor, but an operator had pushed in the blocking bracket 4 to cycle the operator handle 3. Thus we are preventing the contactor from closing as the switch is about to be opened, thus preventing the switch from removing power directly from the motor.

From the above, it should be appreciated that the systems and apparatus described herein provide a reliable interlock system for handle operators, switches, and electric motors. It should also be appreciated that the interlock apparatus of the present invention permits the reduction of parts and adjustment points, increased reliability, and increased safety.

While preferred embodiments have been shown and described, various modifications and substitutions may be made thereto without departing from the spirt and scope of the invention. Accordingly, it is to be understood that the present invention has been described by way of illustrations and not limitation.

What is claimed is:

1. An interlock apparatus for providing an interlock function between a control interface and an electric apparatus to be controlled comprising:

a handle operator, selectively operable to cycle between a first position and a second position;

a bracket, selectively operable between a blocking position and a non-blocking position whereby as long as said bracket is in said blocking position it provides a first interference to said handle operator rendering said handle operator inoperable, and whereby as long as said bracket is in said non-blocking position it provides no said first interference to said handle operator rendering said handle operator operable;

a contactor selectively operable to open or close at least one of a plurality of contacts;

a lock-out member mechanically linked to said contactor, wherein said contactor drives said lock-out member to an enable position when said contactor is open, and said contactor drives said lock-out member to a lock-out position when said contactor is closed;

said lock-out member providing a second interference to said bracket if and only if said lock-out member is in said lock-out position, whereby said second interference prohibits said bracket from operating from said blocking position to said non-blocking position; and said bracket providing a third interference if and only if said bracket is in said non-blocking position, whereby said lock-out member is prohibited operating from said enable position to said lock-out position, and said contactor is prohibited from closing said contacts.

2. An interlock apparatus as in claim 1 and further comprising:

a bracket member having a first end and a second end whereby said first end is mechanically connected to and operable with said bracket, and said second end includes a key;

wherein said bracket member key is operable with said bracket and occupies a first position corresponding to said bracket's blocking position and said bracket member key occupies a second position corresponding to said bracket's non-blocking position.

3. An interlock apparatus as in claim 2 wherein said lock-out member further comprises:

a head having a keyway;

a base mechanically connected to said contactor;

a body connecting said base to said head;

wherein said keyway occupies said enable position corresponding to said contactor being open and said keyway occupies said lock-out position corresponding to said contactor being closed.

4. An interlock apparatus as in claim 3 wherein:

said bracket member includes a rod having a rod first end mechanically connected to said bracket and a rod second end; said rod second end includes said key;

said key is circular in shape; and said keyway is a circular aperture.

5. An interlock apparatus as in claim 4 and further comprising:

a z-bracket having a top leg and a base leg;

said base leg being fixedly attached to said body;

said head and top leg being of planar construction, fixed relative to each other in an essentially parallel manner and separated by a predetermined gap;

said top leg having an elongated aperture aligned in such a manner that said a portion of said elongated aperture overlaps said keyway;

a first key/keyway configuration whereby said key being selectively in said first position is received in said elongated aperture but not yet received in said keyway, said first position corresponding to the bracket blocking position, and said keyway being selectively aligned to receive said key, said alignment corresponding to said contactor being open and said bracket being in said blocking position; whereby said bracket may be operable to a non-blocking position so as to cycle said handle operator;

a second key/keyway configuration whereby said key being selectively in said first position is received in said elongated aperture but not yet received in said keyway, said first position corresponding to the bracket blocking position, and said keyway being selectively misaligned so as not to receive said key, said misaligmnent corresponding to said contactor being closed and said bracket being in said blocking position; said second key/keyway configuration causing said second interference so said bracket is inoperable rendering thus prohibiting said handle operator from being cycled; and a third key/keyway configuration whereby said key being selectively in said second position is received in said elongated aperture and received in said keyway, said second position corresponding to the bracket being in said nonblocking position and to said contactor being open; said third key/keyway configuration causing said third interference whereby said contactor can not close because said key has engaged said keyway preventing said lock-out member from operating from said enable position to said lock-out position.

6. An interlock apparatus as in claim 2 wherein:

said operability of said bracket member is essentially bi-directional in a first motion path;

said operability of said lock-out member is essentially bi-directional in a second motion path; and said first motion path of said bracket member is essentially orthogonal to said second motion path of said lock-out member.

7. A method for providing an interlock function between a control interface and an electric apparatus to be controlled comprising:

providing a handle operator, selectively operable to cycle between a first position and a second position;

providing a bracket, selectively operable between a blocking position and a non-blocking position whereby as long as said bracket is in said blocking position it provides a first interference to said handle operator rendering said handle operator inoperable, and whereby as long as said bracket is in said nonblocking position it provides no said first interference to said handle operator rendering said handle operator operable;

providing a contactor selectively operable to open or close at least one of a plurality of contacts;

providing a lock-out member mechanically linked to said contactor, wherein said contactor drives said lock-out member to an enable position when said contactor is open, and said contactor drives said lock-out member to a lockout position when said contactor is closed;

said lock-out member providing a second interference to said bracket if and only if said lock-out member is in said lock-out position, whereby said second interference prohibits said bracket from operating from said blocking position to said non-blocking position; and said bracket providing a third interference if and only if said bracket is in said non-blocking position, whereby said lock-out member is prohibited operating from said enable position to said lock-out position, and said contactor is prohibited from closing said contacts.

* * * * *